United States Patent [19]

Ivanko

[11] 4,180,371

[45] Dec. 25, 1979

[54] COMPOSITE METAL-CERAMIC TURBINE NOZZLE

[75] Inventor: Theodore Ivanko, Fairfield, Conn.

[73] Assignee: Avco Corporation, Stratford, Conn.

[21] Appl. No.: 888,922

[22] Filed: Mar. 22, 1978

[51] Int. Cl.[2] ..... F01D 5/18; F01D 5/28

[52] U.S. Cl. ..... 415/115; 415/189; 415/200

[58] Field of Search ..... 415/200, 189, 142, 115; 416/241 B

[56] References Cited

U.S. PATENT DOCUMENTS

| | | | |
|---|---|---|---|
| 2,801,076 | 7/1957 | Terrell et al. | 415/200 X |
| 2,914,300 | 11/1959 | Sayre | 415/200 X |
| 2,941,781 | 6/1960 | Boyum | 415/142 |
| 3,118,593 | 1/1964 | Robinson et al. | 415/200 X |
| 3,619,077 | 11/1971 | Wile et al. | 415/115 |
| 3,781,125 | 12/1973 | Rahaim et al. | 415/115 |
| 3,857,649 | 12/1974 | Schaller et al. | 415/200 |
| 4,086,757 | 5/1978 | Karstensen et al. | 415/115 X |

*Primary Examiner*—Everette A. Powell, Jr.
*Attorney, Agent, or Firm*—Ralph D. Gelling

[57] ABSTRACT

A turbine nozzle has a metal inner shroud that is joined to a metal outer shroud by a limited number of metal blades for structural purposes, and includes a plurality of air flow guidance vanes made of ceramic material and connected to the shrouds by spring clips. The composite structure allows the turbine nozzle to operate at higher temperatures with less cooling.

5 Claims, 4 Drawing Figures

COMPOSITE METAL-CERAMIC TURBINE NOZZLE

BACKGROUND OF THE INVENTION

The present invention relates to a turbine nozzle which is located between the combustion chamber and the turbine wheel of a gas turbine, and more particularly a new and improved composite turbine nozzle having metallic structural blades and ceramic airflow vanes so as to reduce the cooling air requirements for the turbine nozzle as well as to allow the turbine nozzle to operate at higher temperatures with less cooling air.

In the well known type of gas turbine commonly referred to as a turbojet, air is compressed in a rotating compressor and heated in the combustion chamber, and then expanded through a gas turbine in which no excess power (above that required to drive the compressor) is supplied by the turbine. To increase the available energy in the temperature cycle, and hence the thrust and efficiency of the engine, designers have conventionally attempted to increase the turbine inlet temperature, since useful turbine engine power is directly related to turbine inlet temperature, as is turbine engine efficiency. In order to achieve a more efficient turbojet operation, i.e., higher cycle temperatures and hence higher thrust values for a given engine size, it has been proposed to use more sophisticated and advanced turbine air-foil cooling techniques to permit higher turbine inlet temperatures. With such techniques, the turbine vane and rotor blade temperatures may be brought within the capability of existing heat or oxidation resistance metallic materials (metals). Lacking the complete availability of such cooling methods or techniques, however, recourse is made to improved blade or vane materials and construction methods.

Heretofore, it has been known to use ceramic materials in conventional blade and vane designs, since ceramic materials have the ability to withstand significantly higher temperatures than the known refractory alloys. In particular, it has been known to use ceramic materials as the leading edge of the turbine airfoil where the temperature is always highest and where cooling is most difficult, since the heat input is highest at the leading edge also. On the other hand, ceramic materials present certain problems in their use, such as the fact that ceramic materials do not have the tensile strength of metallic materials, and also ceramic materials usually have relatively low ductility and thus have a tendency to crack under the impact of severe or suddenly applied thermal shock or stresses as may occur in gas turbines.

Prior art attempts to utilize both metallic and ceramic materials in the construction of a gas turbine nozzle have employed the concept wherein a portion of each airfoil surface is formed of a ceramic material, while the remaining structural portion is formed of a metallic material. This is exemplified by the teachings of U.S. Pat. No. 3,758,233 wherein a ceramic coating is applied to an airfoil shaped element for use in a gas turbine. Reference is also made to a publication article "Ceramic Gas Turbine Has A Promising Future". Iron Age, pages 37, 38 and 39, Mar. 1, 1976 which suggests a ceramic turbine wheel stator made by injection molding the ceramic, then reaction sintering.

None of the prior art teachings, however, is a practical solution to the advantages of marrying ceramic technology and the present state of the art of manufacturing metallic shrouds and airfoil elements to allow them to exist in harmony, and to achieve maximum advantages of both materials, without compromising either the structural or heat-dissipating characteristics thereof. The present invention overcomes the shortcomings of the prior art systems, and provides a new and improved composite turbine nozzle for use in a gas turbine device which is capable of reducing cooling air requirements and allowing higher temperatures with less cooling air.

BRIEF SUMMARY OF THE INVENTION

It is therefore a primary object of the subject invention to provide an improved turbine nozzle made of a composite metal and ceramic turbine elements. It is also an object of the invention to achieve a reduction of costs by the reduction of the number of cooled vanes needed in the turbine nozzle, while at the same time maintaining dimensional tolerance control by using sufficient metallic vanes between inner and outer metal shroud structures not otherwise connected. It is also an object of the subject invention to further provide a new and improved turbine nozzle wherein metal vanes or a part of them are located in lower temperature regions of the turbine nozzle inlet flow.

The foregoing objects, as well as others, which will become apparent from the following detailed description, are accomplished by the present invention. In one form thereof, the invention provides a composite turbine nozzle for use in a gas turbine device and having an outer metallic shroud or casing, an inner metallic shroud or casing, said casings being interconnected by a plurality of metal vanes so as to integrate said outer and inner casings. A plurality of ceramic vanes are interspersed with the metallic vanes and extend between said outer casing and said inner casing. By this arrangement, the cooling air requirements for the high inlet temperature airflow provided to the gas turbine can be reduced, or higher inlet temperatures can be accommodated without additional cooling air. Cost benefits are achieved as the number of cool vanes per engine is substantially reduced, and the structural metal vanes may be selectively located in the lower temperature regions of the inlet to the turbine nozzle. Furthermore, the use of metallic structural vanes maintains the structural integrity of the metal-to-metal control of the inner and outer shroud relationships, and the ceramic vanes are secured to the shrouds by spring clips whereby the ceramic vanes are not required to absorb axial excursions of the shrouds, and thus the ceramic vanes can be made of a simple one-piece design.

DETAILED DESCRIPTION OF THE DRAWINGS

For purpose of facilitating the description of this invention, the appended drawings are incorporated, wherein.

DETAILED DESCRIPTION

Figure 1:
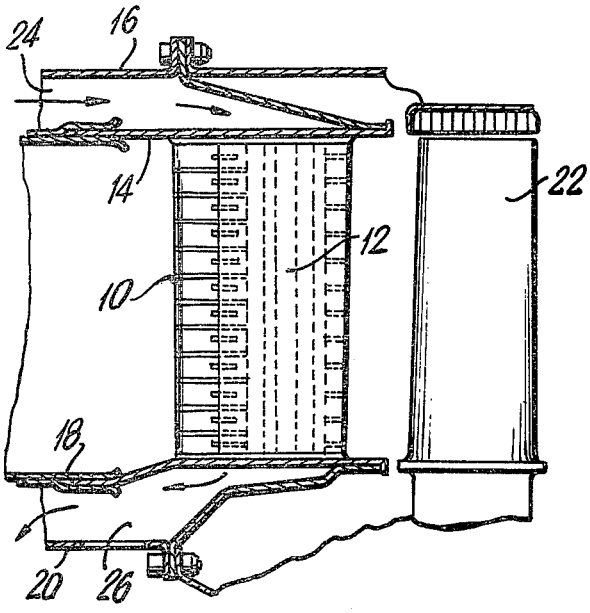
(PRIOR ART) FIG. 1
FIG. 1 is a cross-section of a turbine nozzle portion of a gas turbine engine of the prior art.

FIG. 1 illustrates the prior art structure of U.S. Pat. No. 3,619,077 wherein a ceramic leading edge 10 is provided for a body structure 12 of an airfoil shaped stator vane between a liner 14 of an outer casing 16 and an inner liner 18 for an inner casing 20 of a gas turbine. The outer liner 16 and inner liner 18 form a turbine nozzle for a combustion chamber (not shown) opening towards a turbine wheel, blade portion 22, being shown. In order to effect the desired force, the stator vane comprised of the leading edge 10 and body 12 turn the flow from the nozzle so as to impart a rotational force on the blades 22 of the turbine wheel.

It may thus be appreciated that these stator vanes are exposed to very high temperature gases. In order to obtain adequate life cycle, the all-metal blades were proposed to be changed to a composite of ceramic metal. Also, the metal body was to be open to receive cooling air from passage 24 and exhaust same to passage 26 wherefrom it was generally directed via the turbine wheel section to exhaust in the gas turbine exhaust flow therefrom. It should be noted that this prior art also taught that the entire vane may be made of ceramic wafers with shims therebetween to effect the desired stator vane profile. Such was located between the nozzle liners by a hollow pin to permit cooling air to flow through such ceramic structure as it was to flow in the metal body.

Figure 3:
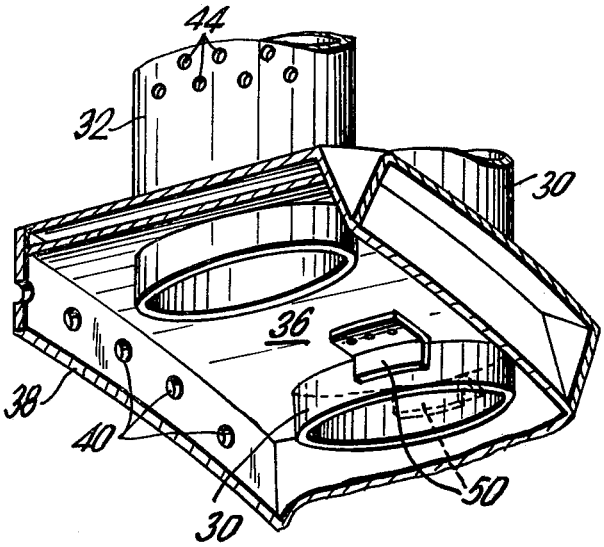
FIG. 3 is a partial isometric view of a stator vane segment for a turbine nozzle according to the subject invention.
Figure 2:
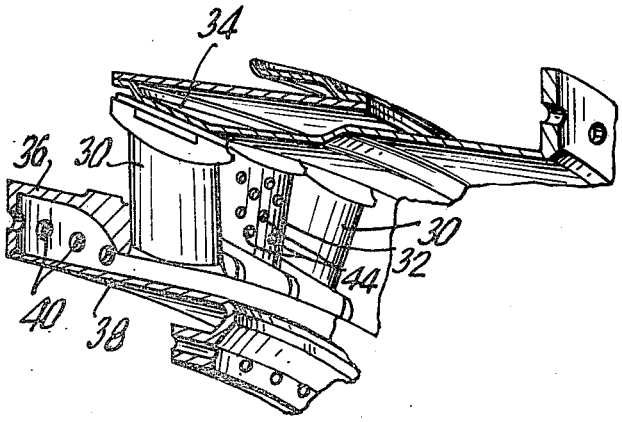
FIG. 2 is a partial isometric of a cross-section of a turbine nozzle according to the subject invention.
Figure 4:
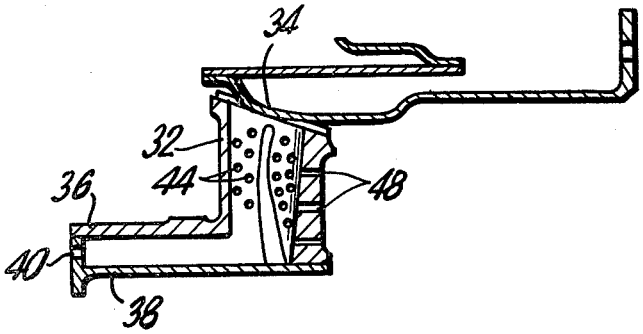
FIG. 4 is a cross-sectional view of the metal vane in the turbine nozzle according to the subject invention.

Contrasted to this is the new and improved composite turbine nozzle of the subject invention as illustrated in FIGS. 2–4. As shown in FIG. 2, the turbine nozzle of the invention includes a plurality of blades 30 formed from a ceramic composition to either side of an all metal blade 32 between outer metallic casing 34 and an inner metallic liner 36 connected (by means not shown) to an inner casing 38. The latter includes a plurality of drilled passages 40 to conduct cooling air into the metal blade 32 wherefrom it is exhausted via surface openings 44 thereof. As seen in FIG. 4, each metal blade 32 also has trailing edge openings 48 for exhaust of cooling air. As seen in FIG. 3 a spring clip 50 is attached to casing liner 36, and locates the ceramic vane 30. Similar means are suggested for the outer casing vane juncture.

Accordingly, the subject invention provides a composite metal and ceramic turbine nozzle which reduces cooling air requirements and allows higher temperatures with less cooling air. This will allow also the reduction of costs by the reduction of the number of cooled metallic vanes needed in the nozzle, while at the same time maintaining dimensional tolerance control by using sufficient metal vanes between inner and outer metal structures, not otherwise connected. It is also possible to further improve this by locating the metal vanes or a part of them in lower temperature regions of the nozzle inlet flow from the combustor. It is also possible with the subject invention to realize a more advantageous employment of inner and outer metal shroud flexibilities in diminishing shroud imposed vane loads. Finally, with the metal vanes 32 maintaining the axial position of the shrouds, the ceramic vanes 30 are not required to absorb axial excursions. This means that, in contrast to the prior art use of wafers to construct such ceramic vanes, the ceramic vanes of the subject invention can be of simple one piece design.

It will be understood that such other embodiments or obvious changes that are within the spirit and scope of the invention, as disclosed herein, are intended also to be covered by the claims appended thereto.

What is claimed is:

1. A turbine nozzle comprising:

an outer casing, said outer casing being of a predetermined metal composition with means to affix its location;

an inner case of similar metal, said inner casing having a passageway therethrough and also having means to affix its location;

a first array of vanes, also of similar metal as said outer and inner casing, said metallic vanes connecting said inner and outer casing and supporting said inner casing to said outer casing, each metallic vane having a hollowed interior open to the passage of the inner casing and adapted to be air cooled;

a second array of vanes made of a solid, ceramic material, said second array of ceramic vanes alternating with the first array of metallic vanes, each of said ceramic vanes extending between said outer casing and said inner casing; and spring clips affixed to the outer and inner casing for frictionally locating the ceramic vanes such that the ceramic vanes do not absorb radial excursions of the outer casing and the inner casing during flow of high temperature fluid.

2. The turbine nozzle of claim 1 and further characterized by means to supply cooling fluid to said metal vanes.

3. The turbine nozzle of claim 2 wherein the means to supply cooling fluid is a passage in the inner casing leading to a chamber open to a hollow interior of said metal vanes.

4. The turbine nozzle of claim 3 wherein the vanes have passages from the hollow interior through their surface in the nozzle to exhaust the cooling fluid thereinto.

5. The turbine nozzle of claim 1 wherein the ceramic vanes project through both outer and inner casings.

* * * * *